US005942053A

United States Patent [19]

Sekine et al.

[11] Patent Number: 5,942,053

[45] Date of Patent: Aug. 24, 1999

[54] COMPOSITION FOR PERMANENT MAGNET

[75] Inventors: Shigenobu Sekine; Hiroji Sato; Minoru Narita, all of Tokyo, Japan

[73] Assignee: Sanei Kasei Co., Ltd., Tokyo, Japan

[21] Appl. No.: 09/089,222

[22] Filed: Jun. 3, 1998

[30] Foreign Application Priority Data

Apr. 22, 1998 [JP] Japan ..... 10-112126

[51] Int. Cl.[6] ..... H01F 1/057

[52] U.S. Cl. ..... 148/302; 148/101; 148/102; 420/83; 420/121

[58] Field of Search ..... 148/302, 101, 148/102; 420/121, 83

[56] References Cited

U.S. PATENT DOCUMENTS

| | | | |
|---|---|---|---|
| 4,770,723 | 9/1988 | Sagawa et al. . | |
| 4,792,368 | 12/1988 | Sagawa et al. . | |
| 4,840,684 | 6/1989 | Fujimura et al. . | |
| 4,952,252 | 8/1990 | Ghandehari | 148/105 |
| 5,096,512 | 3/1992 | Sagawa et al. . | |
| 5,183,516 | 2/1993 | Sagawa et al. . | |
| 5,194,098 | 3/1993 | Sagawa et al. . | |
| 5,194,099 | 3/1993 | Esper et al. | 148/302 |
| 5,466,308 | 11/1995 | Fujimura et al. . | |
| 5,645,651 | 7/1997 | Fujimura et al. . | |

FOREIGN PATENT DOCUMENTS 7-78269 5/1983 Japan .

*Primary Examiner*—John Sheehan
*Attorney, Agent, or Firm*—Pillsbury Madison & Sutro LLP

[57] ABSTRACT

The object of the invention is to provide a composition for permanent magnet with excellent magnetic properties exhibiting well the latent ability of the RFeB system tetragonal compounds. The composition for permanent magnet according to the present invention is a complex of (1) a crystalline RFeB or RFeCoB system compound having a tetragonal crystal structure with lattice constants of $a_o$ about 8.8 Å and $c_o$ about 12 Å, in which R is at least one of rare earth elements, and (2) a crystalline neodymium oxide having a cubic crystal structure, in which both crystal grains are epitaxially connected and the RFeB or RFeCoB crystal grains are oriented to the $c_o$ direction. The lattice constant $a_o$ of the cubic $Nd_2O_3$ is about 4.4 Å which is the half length of the lattice constant $a_o$ about 8.8 Å for the RFeB or RFeCoB tetragonal crystal, and the epitaxial connection is achieved, and the RFeB or RFeCoB crystal grains are oriented to the $c_o$ direction.

5 Claims, 8 Drawing Sheets

FIG. IA
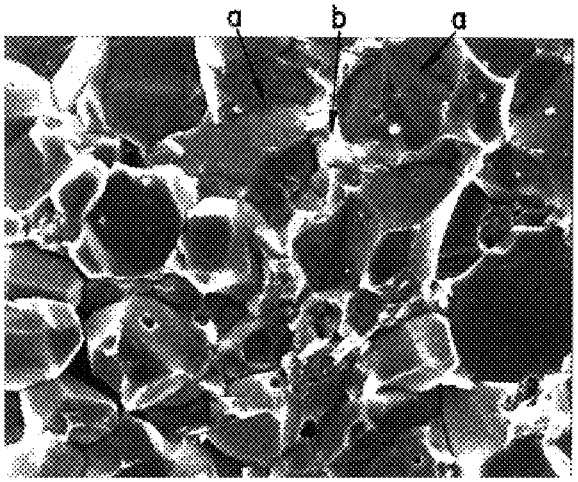
FIG. IB
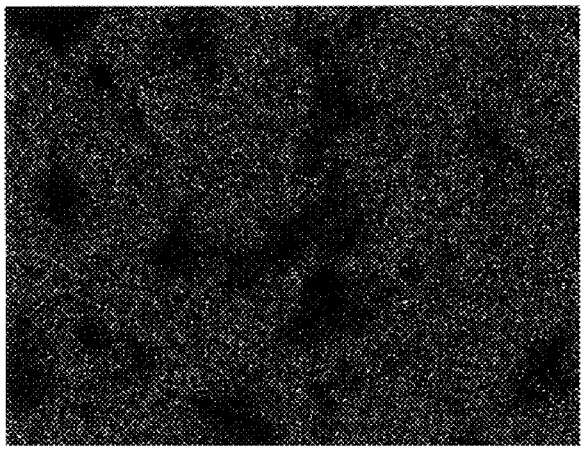

COMPOSITION FOR PERMANENT MAGNET

FIELD OF THE INVENTION

The present invention relates to a composition for permanent magnet superior in magnetic properties.

BACKGROUND OF THE INVENTION

As materials for permanent magnet, Japanese patent publication Hei7-78269 (Japanese patent application Sho58-94876, the patent families include U.S. Pat. Nos. 4,770,723; 4,792,368; 4,840,684; 5,096,512; 5,183,516; 5,194,098; 5,466,308; 5,645,651) discloses (a) RFeB compounds containing R (at least one kind of rare earth element including Y), Fe and B as essential elements and having a tetragonal crystal structure with lattice constants of $a_o$ about 9 Å and $c_o$ about 12 Å, and each compound is isolated by non magnetic phase, and (b) RFeBA compounds containing R, Fe, B and A (Ti, Ni, Bi, V, Nb, Ta, Cr, Mo, W, Mn, Al, Sb, Ge, Sn, Zr, Hf, Cu, S, C, Ca, Mg, Si, O, or P) as essential elements and having a tetragonal crystal structure with lattice constants of $a_o$ about 9 Å and $c_o$ about 12 Å, and each compound is isolated by non-magnetic phase. It is mentioned that the permanent magnet has a good property when (1) the above tetragonal compounds have an appropriate crystal grain size, (2) the compounds are the major phase, and (3) microstructure of the compounds mixed with the R-rich non-magnetic phase is formed.

According to Example 2 of the Japanese patent publication Hei7-78269, for example, an alloy of 8 atom % B, 15 atom % Nd and the balance Fe was pulverized to prepare an alloy powder having an average particle size of 3 $\mu$m. The powder was compacted in a magnetic field of 10 kOe under a pressure of 2 t/cm$^2$ and sintered at 1100° C. for 1 hour in Ar of $2\times10^{-1}$ Torr. The magnetic properties are: Br=12.1 kG, Hc=9.3 kOe, and (BH)max=34 MGOe. The major phase of the sintered compact is a tetragonal compound with lattice constants of $a_o$=8.8 Å and $c_o$=12.23 Å. The major phase contains simultaneously Fe, B and Nd, and amounts to 90.5 volume % of the sintered compact. As to the non-magnetic interface phase which isolates the major phase, a non-magnetic phase containing more than 80% of R occupies 4 volume % and the remainder is virtually oxides and pores.

Though said magnet shows excellent magnetic properties, the latent ability of the RFeB or RFeBA tetragonal compounds have not been exhibited fully. This may be due to the fact that the tetragonal compounds are not well-oriented to the $c_o$ direction since the R-rich phase isolating the major phase of the tetragonal compounds is an amorphous phase.

SUMMARY OF THE DISCLOSURE

The object of the invention is to provide a composition for permanent magnet with excellent magnetic properties exhibiting well the latent ability of the RFeB system tetragonal compounds.

The composition for permanent magnet according to the present invention is a complex of (1) a crystalline RFeB or RFeCoB system compound having a tetragonal crystal structure with lattice constants of $a_o$ about 8.8 Å and $c_o$ about 12 Å, in which R is at least one of rare earth elements, and (2) a crystalline neodymium oxide having a cubic crystal structure, wherein both crystal grains are epitaxially connected and the RFeB or RFeCoB crystal grains are oriented to the $c_o$ direction. Usually, Nd is preferably employed as R, and rare earth elements such as Pr may be usable under the conditions that enough amount of Nd necessary to form neodymium oxides is to be contained. As for the neodymium oxides, $Nd_2O_3$, NdO, and $NdO_2$ are preferably used for the present invention, because they have a cubic crystal structure.

BRIEF DESCRIPTION OF THE DRAWINGS

FIGS. 1A–1F is scanning electron microscope images of the composition for a permanent magnet prepared by the present invention. FIG. 1A, [SEM] shows the distribution of the grains. The images FIG. 1B [Co], FIG. 1C [Fe], FIG. 1D [Nd], FIG. 1E [O] and FIG. 1F [Pr] show the distribution of Co, Fe, Nd, O and Pr in the same area as the [SEM] image, respectively.

DETAILED DESCRIPTION OF THE PREFERRED EMBODIMENTS

Figure 1C:
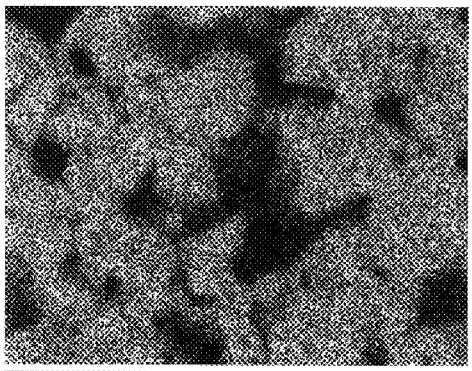
Figure 1D:
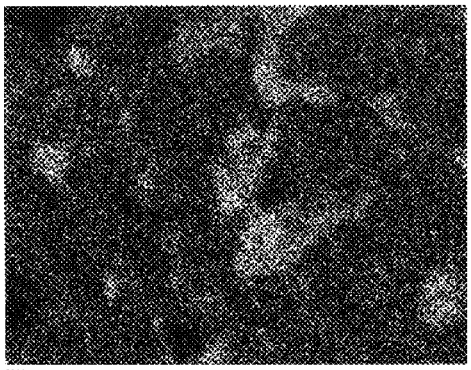
Figure 1E:
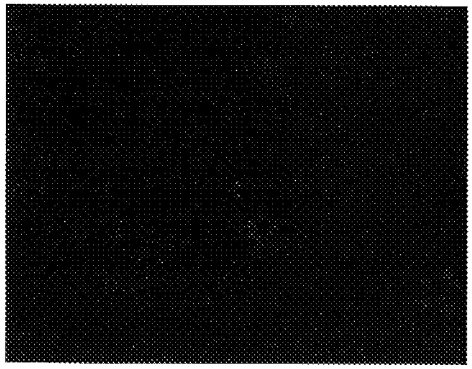
Figure 1F:
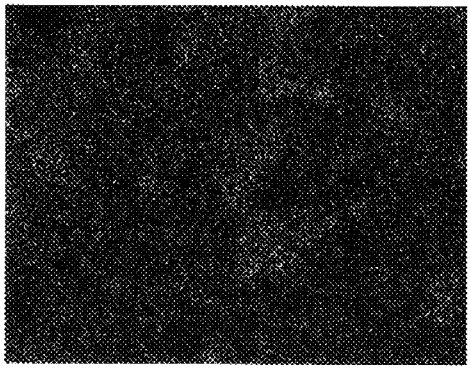

Magnetic compositions of the present invention and of Japanese Patent publication Hei7-78269 are the same in that the major phase of the composition is composed of RFeB system tetragonal compounds having lattice constants of $a_o$ about 8.8 Å and $c_o$ about 12 Å. However, while the RFeB tetragonal compounds in the Japanese patent Hei 7-78269 are isolated with R-rich amorphous non-magnetic phases, the RFeB tetragonal compounds in the present invention are isolated with neodymium oxide crystal grains having a cubic structure, and further, both the RFeB compounds and neodymium oxide grains are epitaxially connected to cause the RFeB compounds being highly oriented. The magnet obtained by the present invention differs in this point from that of the prior art.

In general, rare-earth.iron.boron system permanent magnets are prepared by providing an alloy of predetermined composition, pulverizing the alloy in an inert gas atmosphere for prevention of the oxidation, compacting the alloy powder under a magnetic field, and sintering the compacted powder in an inert gas. However, according to the preparing method, it is difficult to obtain the epitaxial connection between the RFeB tetragonal compounds and the cubic crystal system $Nd_2O_3$ (or NdO, $NdO_2$) to form a well-oriented RFeB crystal.

The composition for a permanent magnet according to the present invention is obtainable by controlling the amount of oxygen in the complex. More specifically, RFeB alloys or RFeCoB alloys having predetermined compositions for magnets, or such R-containing raw material composing a part of the alloy components as Nd, Nd—Fe or Nd—Fe—Co metals are crushed, the crushed raw material and crushed zinc are mixed in an inactive organic solvent, preferably toluene, containing a small amount of water under flowing of an inert gas containing a small amount of oxygen, pulverizing the mixture by wet process to obtain finely pulverized particles having average diameter of 1–100 $\mu$m. Then, if necessary, additional metal powder is included into the solvent to compensate the deficient component for predetermined composition, and further pulverized upon necessary. The crushed powder is dried in a non-reactive gas stream and calcined. The calcined powder is compacted in a magnetic field in an ordinary way, and sintered to obtain permanent magnets. The zinc acts not only as a size controller of RFeB or RFeCoB compounds and Nd oxide particles on the calcining process but also as a surfactant to connect the RFeB or RFeCoB compounds with Nd oxide grains epitaxially. The zinc evaporates during the sintering and hardly remain in the composition.

The volumetric ratio of the cubic crystal system $Nd_2O_3$ (or NdO, $NdO_2$) to the tetragonal crystal system RFeB or RFeCoB is set at 1–45%, and preferably is set at 2–30%.

Constituents and effects of the present invention will be described concretely with an example hereunder, however, they are never to be limited to the example. For instance, not only the compounds with different stoichiometric ratios of R:Fe:B or R:Fe:Co:B but also the RFeB compounds containing various additives as shown in the table 1 on the Japanese patent publication H7-78269 can be the basic composition of the present invention, as long as the compounds have a tetragonal structure with the lattice constants of $a_o$ about 8.8 Å and $c_o$ about 12 Å. This is due to the fact that the lattice constant $a_o$ of the cubic $Nd_2O_3$ is about 4.4 Å which is the half length of the lattice constant $a_o$ about 8.8 Å for the RFeB or RFeCoB tetragonal crystal, through which the epitaxial connection is achieved. Though it is possible to use Pr for a part R of RFeB or RFeCoB, the main component of the R should be Nd in order to form the epitaxial connection. The $Nd_2O_3$ is particularly preferred for the neodymium oxide, but it is allowable to have NdO and $NdO_2$ partly. By controlling the oxidizing condition (controlling the concentration of water in the non-reactive organic solvent and oxygen in the non-reactive gas used in the present invention, and the temperature), the $Nd_2O_3$ is mainly obtained.

EXAMPLE 1

One hundred weight parts raw material powder having basically a composition of $Nd_2Fe_{14}B$ in which a part of Fe was substituted with Co and a part of Nd was substituted with Pr, and 1 weight part Zn powder were mixed and crushed in toluene containing 100 ppm water under Ar gas atmosphere containing 1 volume % oxygen, and the resulted powder having an average particle size of 2 $\mu$m was dried under Ar gas stream containing no oxygen gas. The dried powder was compacted at 2 t/cm$^2$ under a magnetic field of 30 kOe, and the compact was sintered at 1080° C. for an hour in Ar gas at 1.5 Torr to obtain a permanent magnet.

Scanning electron microscope images of the sintered compounds are shown in FIGS. 1A–1F. The image FIG. 1A [SEM] in shows the distribution of the grains, in which relatively larger grains (e.g. a) and relatively smaller grains (e.g. b) are connected, and the larger grains are isolated by the smaller grains. The images FIG. 1B [Co], FIG. 1C [Fe], FIG. 1D [Nd], FIG. 1E [O] and FIG. 1F [Pr] show the distribution of Co, Fe, Nd, O and Pr in the same area as the FIG. 1A [SEM] image, respectively. Fe and Co are distributed in the larger grains such as a, and are few in the smaller grains such as b. On the other hand, Nd is mainly distributed in the smaller grains such as b, but less in the larger grains such as a. O is dominantly distributed in the smaller grains such as b, and is few in the larger grains such as a. Pr is mainly distributed in the larger grains such as a. From these distribution observations, it is understood that relatively larger grains mainly contain Fe, Co, Nd, Pr, whereas relatively smaller grains mainly contain Nd and O. B cannot be detected through this experimental method.

Figure 2:
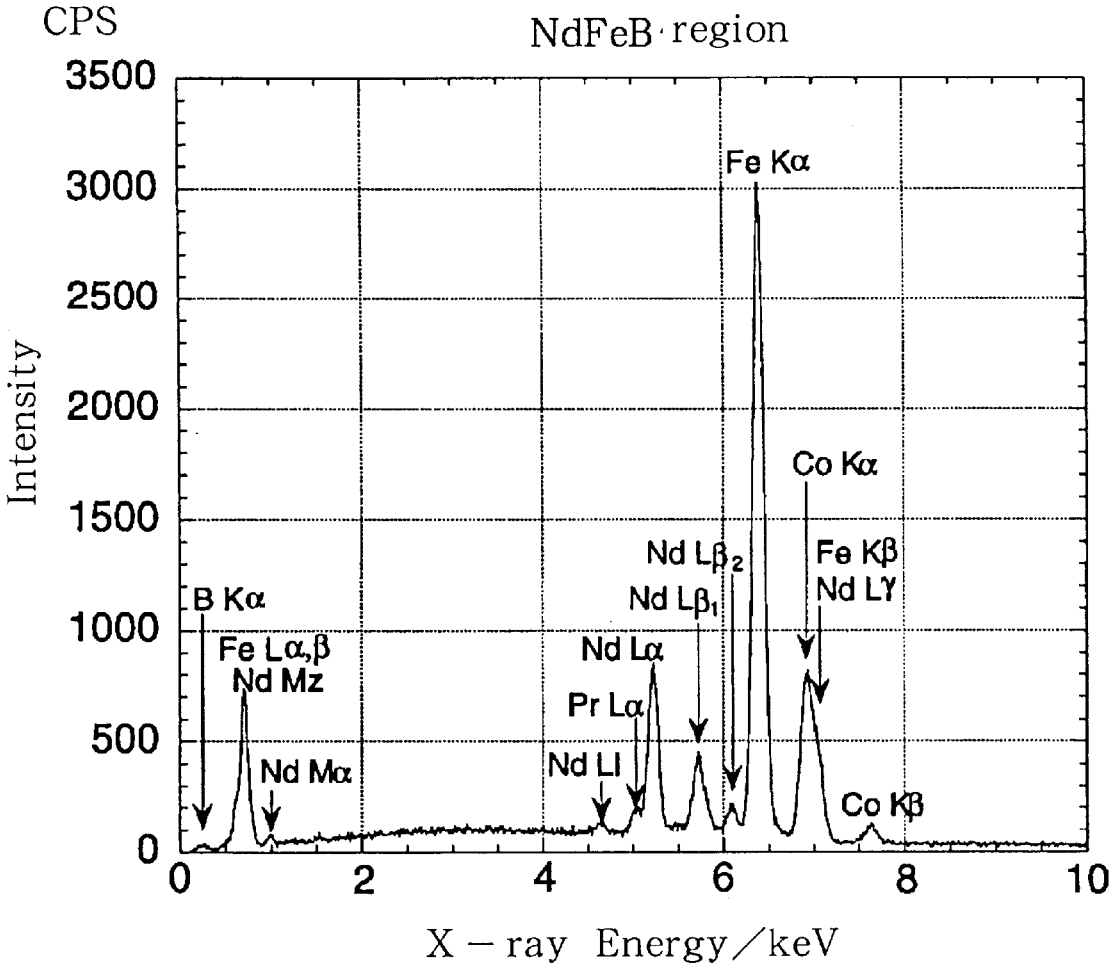
FIG. 2 shows an EDX spectrum of grains having a composition of almost the same as the grain a shown in FIG. 1A [SEM].

FIG. 2 shows an energy dispersive X-ray (EDX) spectrum of grains having a composition of almost the same as the grain a shown in the FIG. 1A [SEM] image. The spectrum shows that the grain a contains mainly Fe together with Co, Nd, Pr and B.

Figure 3:
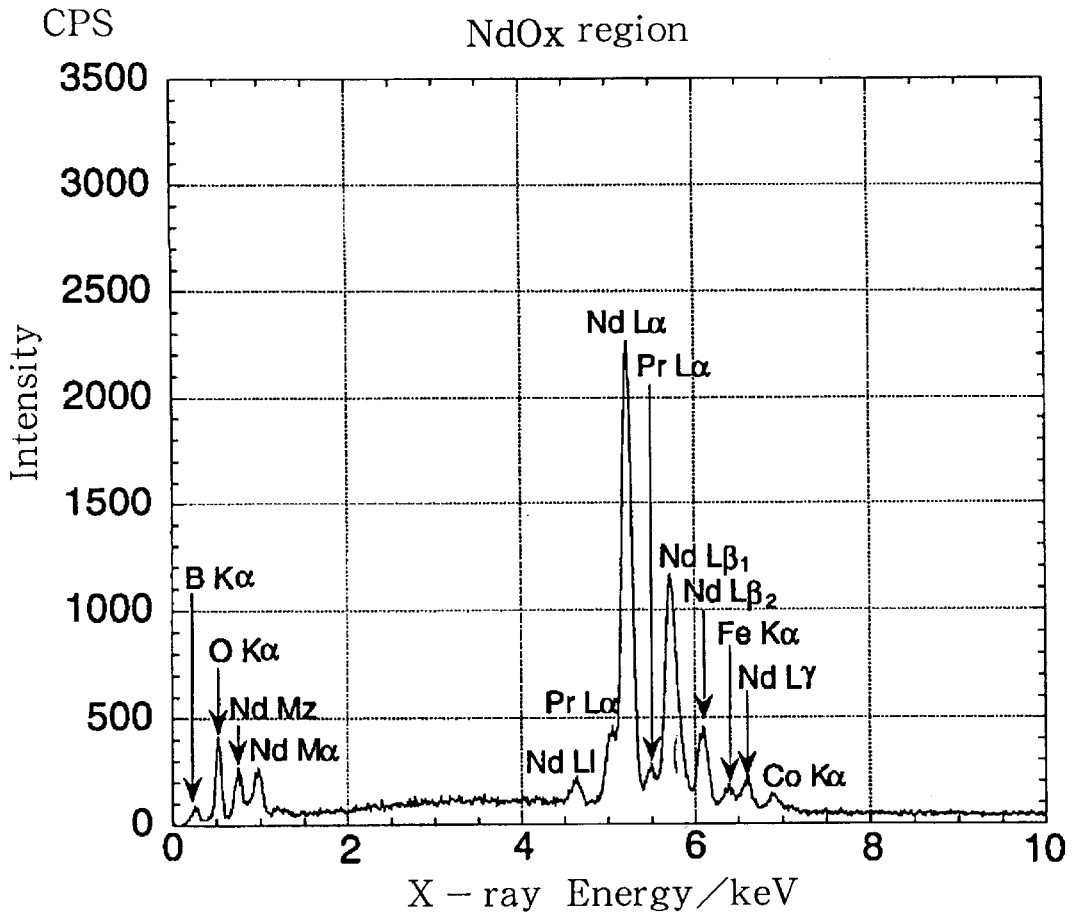
FIG. 3 shows an EDX spectrum of grains having a composition of almost the same as the grain b shown in FIG. 1A [SEM].

FIG. 3 shows an EDX spectrum of grains having a composition of almost the same as the grain b shown in FIG. 1A [SEM]. The spectrum shows that the grain b contains mainly Nd and O, together with Pr, Fe, Co and B.

Figure 4:
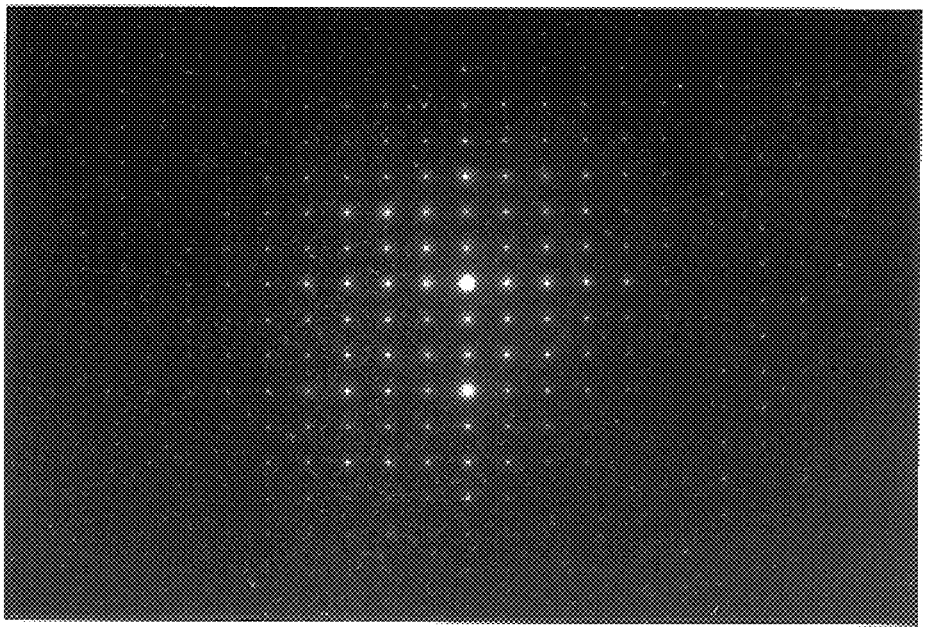
FIG. 4 shows a TED pattern of grains having a composition of almost the same as the grain a shown in FIG. 1A [SEM].

FIG. 4 shows a transmission electron diffraction (TED) pattern of the grains having a composition of almost the same as the grain a shown in the FIG. 1A [SEM] image. This pattern shows that the grain a has a tetragonal structure with the lattice constant $a_o$ about 8.8 Å. The lattice constant $c_o$ about 12 Å was confirmed from another TED pattern at different electron beam incidence.

Figure 5:
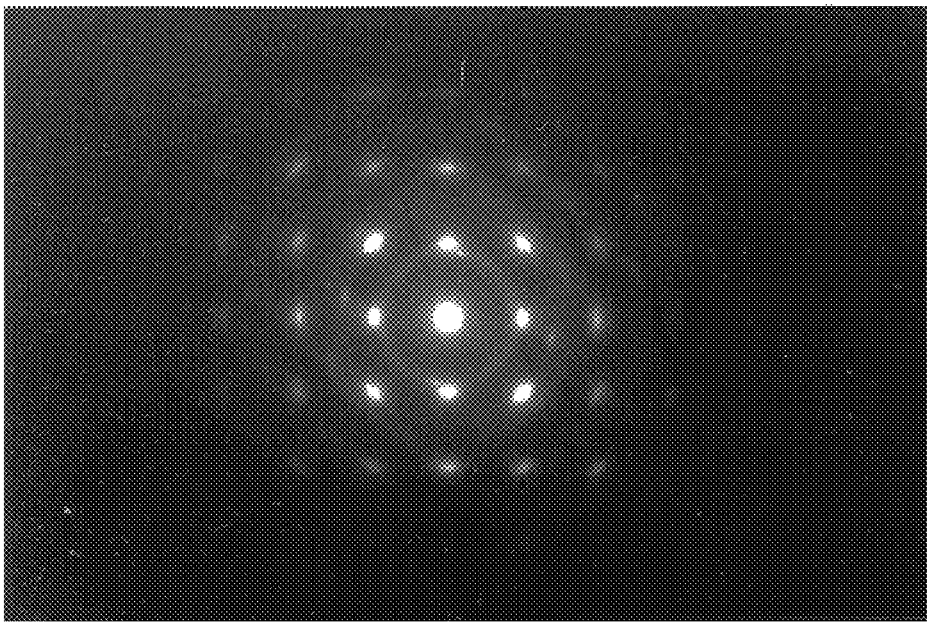
FIG. 5 shows a TED pattern of grains having a composition of almost the same as the grain b shown in FIG. 1A [SEM].

FIG. 5 is a TED pattern of the grains having a composition of almost the same as the grain b shown in the FIG. 1A [SEM] image. This pattern shows that the grain has a cubic structure with the lattice constant $a_o$ about 4.4 Å. The relation that the lattice constant $a_o$ about 4.4 Å for the cubic grains is the half length of the lattice constant $a_o$ about 8.8 Å for the tetragonal crystal grains is important for the epitaxial connection.

Figure 6:
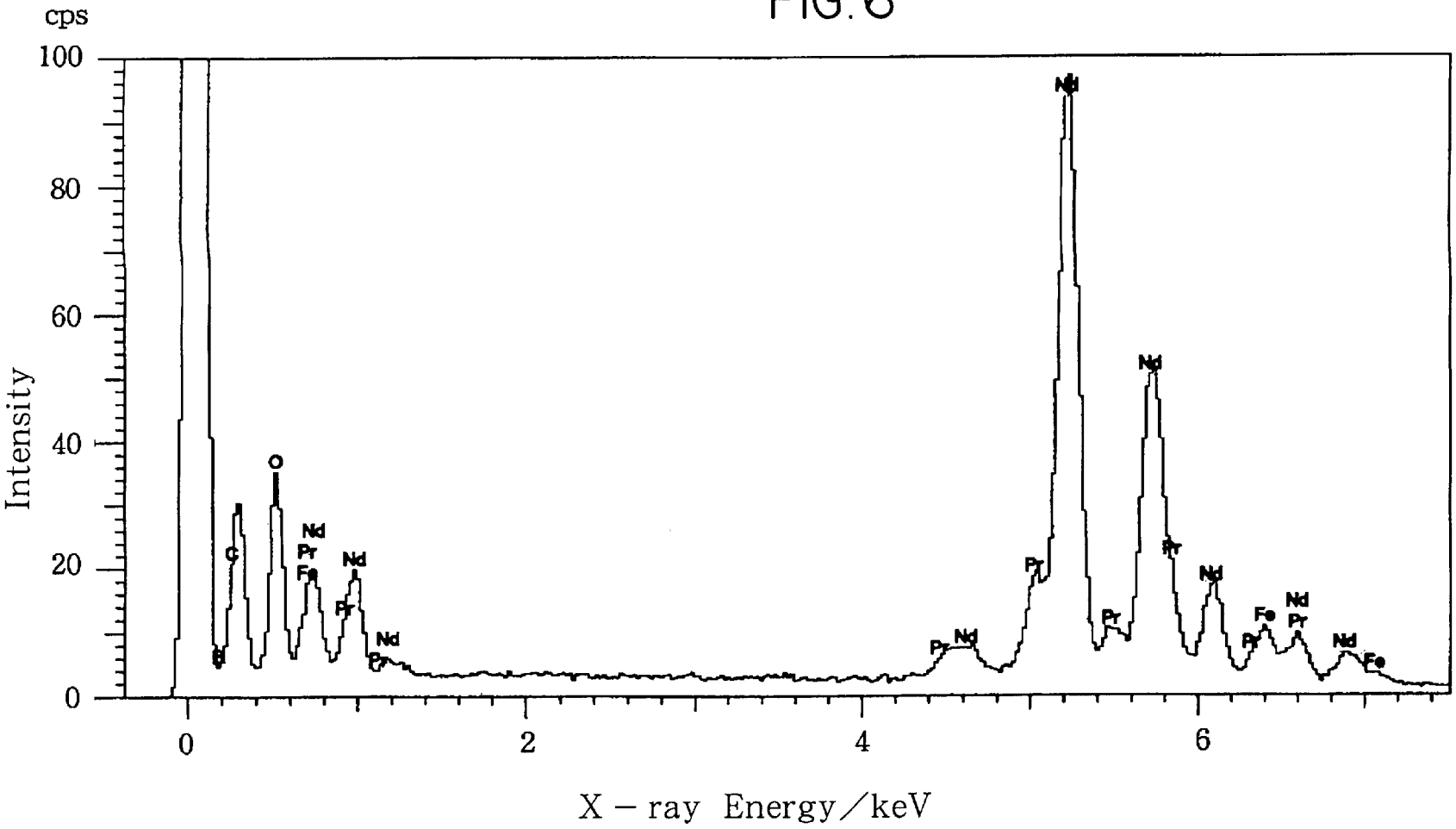
FIG. 6 shows an EDX spectrum of Nd-rich grains having a composition of different from the grains shown in FIG. 3.
Figure 7:
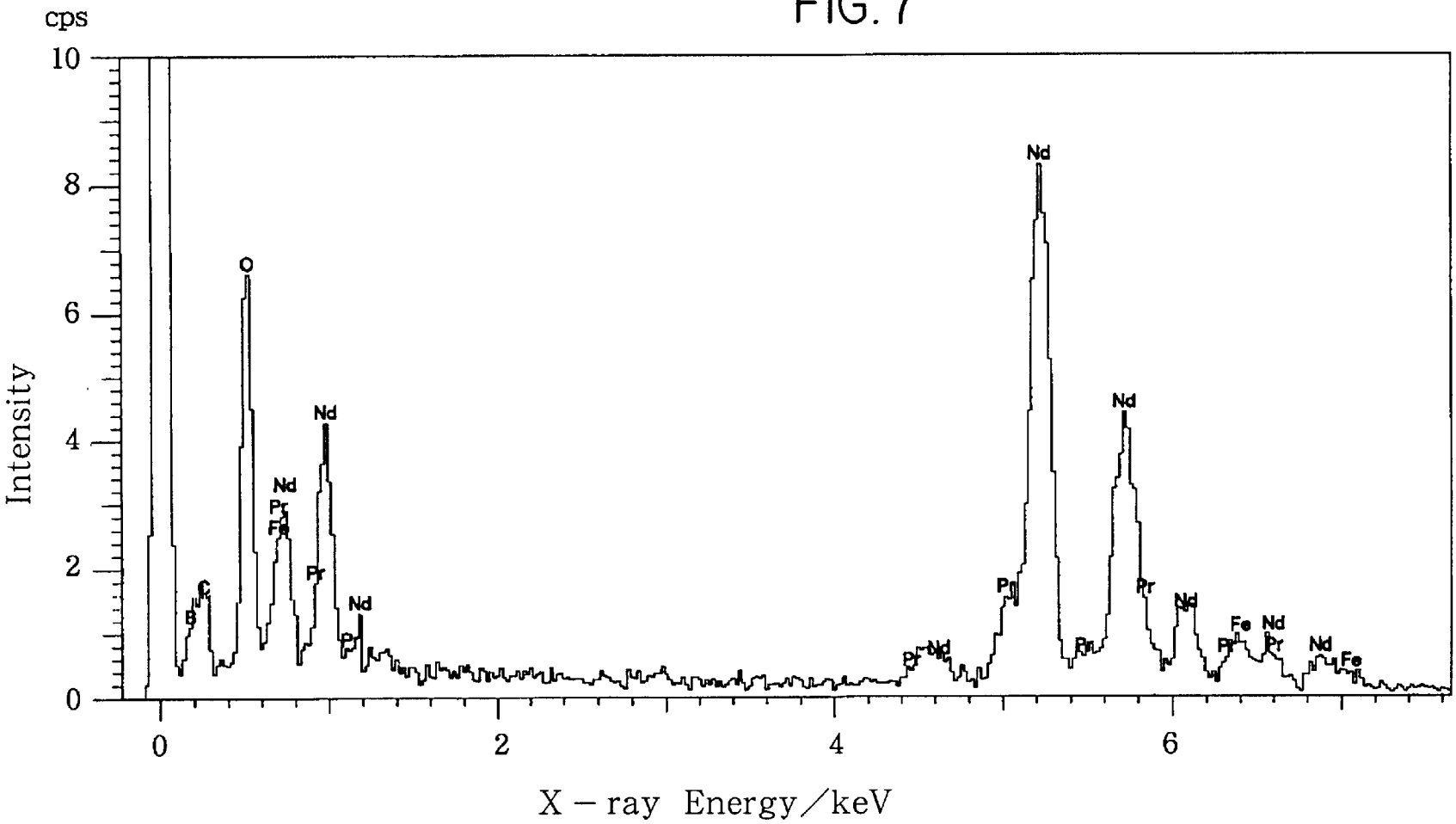
FIG. 7 shows an EDX spectrum of Nd-rich grains having a composition of different from the grains shown in FIG. 3 and FIG. 6.

FIG. 6 shows an EDX spectrum of Nd-rich grains having a composition of different from the grains shown in FIG. 3, and FIG. 7 shows an EDX spectrum of Nd-rich grains having a composition of different from the grains shown in FIG. 3 and FIG. 6. The compositions of some relatively smaller grains on the FIG. 1A [SEM] image are NdO or $NdO_2$ was confirmed by FIGS. 6 and 7, respectively. The stoichiometries of Nd and O for the grains evaluated from the spectra are 1:1 and 1:2 respectively.

Figure 8:
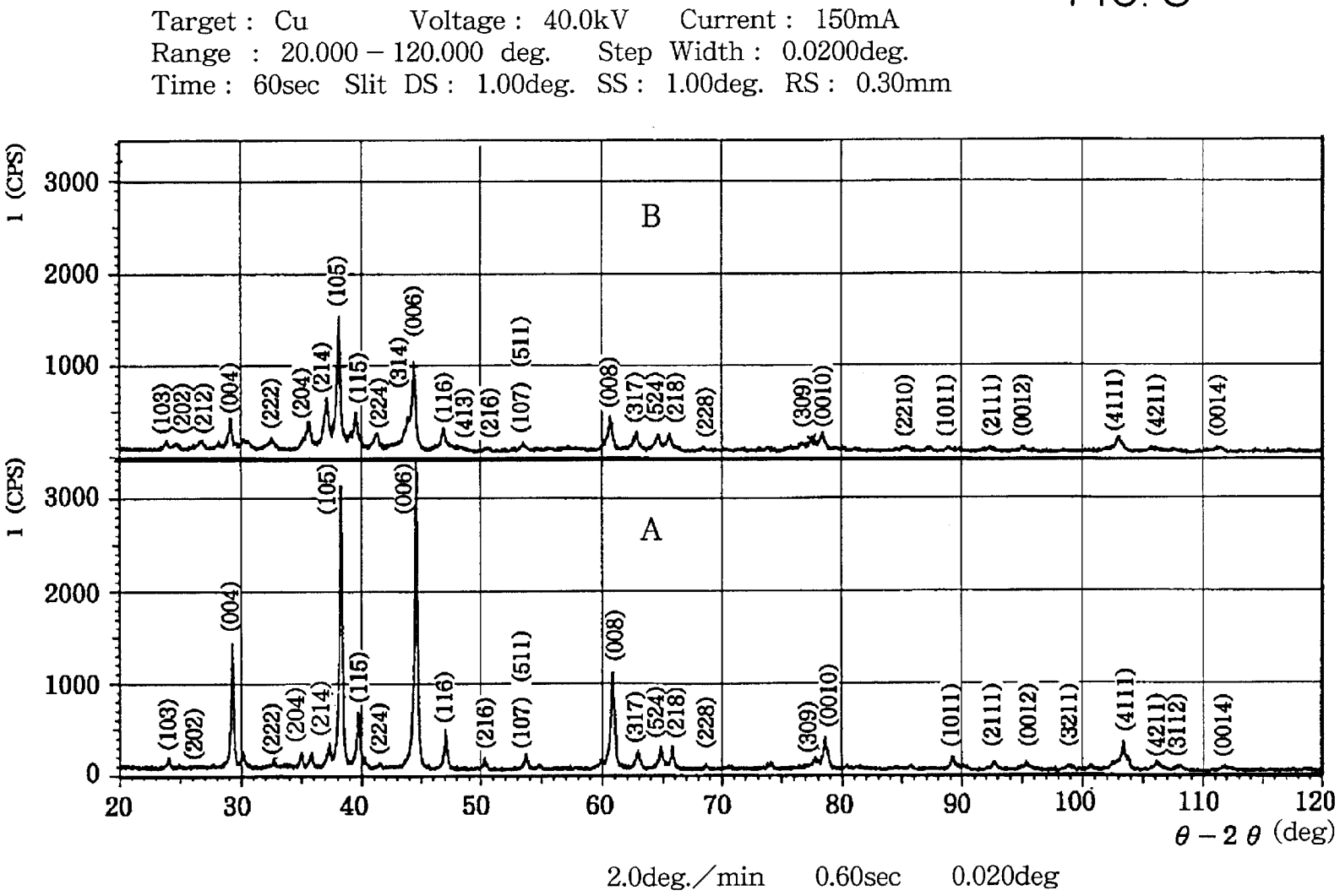
FIG. 8 shows a X-ray diffraction patterns of the magnets prepared by Example 1 (A) and Comparative Example 1 (B), respectively.

The X-ray diffraction pattern of the sintered magnet according to the present invention is shown in FIG. 8A. The intensities at (004) and (006) diffractions, indicating the degree of orientation toward the c-axis, are 1450 and 3400 cps respectively. The orientation toward c-axis direction is better than that on the comparative example 1. The intensity at (105) diffraction, a little bit tilted from the c-axis, is 3150 cps, which is not small intensity, but smaller than that at (006) diffraction.

From these results, it can be understood that the sintered compound of Example 1 is a complex consisted of RFeCoB grains having a tetragonal structure with lattice constants of $a_o$ about 8.8 Å and $c_o$ about 12 Å and NdOx grains having a cubic structure, both of which is epitaxially connected so that the RFeCoB grains are highly-oriented. It is noted that the volume ratio of the relatively larger grains ($Nd_2Fe_{14}B$ tetragonal crystal) and smaller grains (NdOx cubic crystal) was 4:1.

The magnetic properties were Br=15.9 kG, Hc=6.99 kOe, and (BH)max=55.9 MGOe. The superiority of the properties of the magnet compared with that of Comparative Example 1 shown later is due to the crystallinity of NdOx and the high orientation of the RFeB or RFeCoB crystals.

COMPARATIVE EXAMPLE 1

A reference magnet was produced from the same dried raw material powder having a basic composition of $Nd_2Fe_{14}B$ in which a part of Fe was substituted with Co and a part of Nd was substituted with Pr, as used for Example 1. The dried raw material powder was pressed at 2 t/cm$^2$ in a magnetic field of 30 kOe and sintered at 1080° C. for an hour in an Ar gas at 1.5 Torr. The X-ray diffraction pattern of the sintered product is shown in FIG. 8B. The intensities at (004) and (006) diffractions, indicating the degree of orientation to the c-axis, are 450 and 1050 cps respectively, and the intensity at (105) diffraction, a little bit tilted from the c-axis, is 1600 cps, which is more than that at the (006) diffraction. Hence, it is concluded that the orientation toward the c-axis direction for the magnet in the present invention is better than that of comparative example 1. The magnetic properties of the reference magnet were Br=12.8 kG, Hc=14.6 kOe, and (BH)max=46.0 MGOe.

What is claimed is:

1. A permanent magnet comprising a complex of:

(1) a crystalline RFeB or RFeCoB compound having a tetragonal crystal structure with lattice constants of $a_o$ about 8.8 Å and $c_o$ about 12 Å, in which R is at least one of rare earth elements, and (2) a crystalline neodymium oxide having a cubic crystal structure, wherein both crystal grains of (1) and (2) are epitaxially connected and the RFeB or RFeCoB crystal grains are oriented to the $c_o$ direction.

2. A permanent magnet according to claim 1, wherein R is Nd.

3. A permanent magnet according to claim 1, wherein cubic neodymium oxide is $NdO_x$ (x=1, 1.5, or 2).

4. A permanent magnet according to claim 1, wherein the volumetric ratio of the cubic crystalline neodymium oxide to the tetragonal crystalline RFeB or RFeCoB is 1–45%.

5. A method for preparing a permanent magnet comprising a complex of (1) a crystalline RFeB or RFeCoB compound having a tetragonal crystal structure with lattice constants of $a_o$ about 8.8 Å and $c_o$ about 12 Å, in which R is at least one of rare earth elements, and (2) a crystalline neodymium oxide having a cubic crystal structure, wherein both crystal grains of (1) and (2) are epitaxially connected and the RFeB or RFeCoB crystal grains are oriented to the $c_o$ direction, comprising the following steps:

mixing precursor, selected from the group consisting of RFeB powder and RFeCoB powder, with Zn powder in an organic solvent;

crushing the mixed powders in the solvent under an inert gas atmosphere containing up to 1 volume percent oxygen, said Zn acting as a catalyst to oxidize R to form R-oxide cubic crystals of $R_2O_3$ and $RO_x$, x=1, 1.5 or 2, in epitaxial connection with the tetragonal crystals of RFeB or RFeCoB;

drying the crushed powders in an inert gas;

compacting the dried powders under a magnetic field; and sintering the compacted powder and evaporating the Zn under pressure in an inert gas.

* * * * *